US009889338B2

(12) United States Patent
Yu

(10) Patent No.: US 9,889,338 B2
(45) Date of Patent: Feb. 13, 2018

(54) FOAM ROLLER TRACT AND STRETCH DEVICE

(71) Applicant: Chang Jun Yu, Mount Prospect, IL (US)

(72) Inventor: Chang Jun Yu, Mount Prospect, IL (US)

( * ) Notice: Subject to any disclaimer, the term of this patent is extended or adjusted under 35 U.S.C. 154(b) by 0 days.

(21) Appl. No.: 14/940,470

(22) Filed: Nov. 13, 2015

(65) Prior Publication Data

US 2016/0136478 A1 May 19, 2016

Related U.S. Application Data

(60) Provisional application No. 62/079,898, filed on Nov. 14, 2014.

(51) Int. Cl.

| | |
|---|---|
| ***A63B 21/02*** | (2006.01) |
| ***A63B 23/02*** | (2006.01) |
| ***A63B 21/00*** | (2006.01) |
| ***A63B 23/00*** | (2006.01) |
| *A63B 26/00* | (2006.01) |

(52) U.S. Cl.

CPC ..... *A63B 23/0238* (2013.01); *A63B 21/0004* (2013.01); *A63B 21/00047* (2013.01); *A63B 21/00178* (2013.01); *A63B 21/00189* (2013.01); *A63B 21/4023* (2015.10); *A63B 21/4039* (2015.10); *A63B 23/00* (2013.01); *A63B 26/003* (2013.01); *A63B 2023/006* (2013.01)

(58) Field of Classification Search

CPC ..... A63B 23/0238; A63B 23/00; A63B 2023/006; A63B 21/0047; A63B 21/0004; A63B 21/00189; A63B 21/00178; A63B 21/4039; A63B 21/4023

See application file for complete search history.

(56) References Cited

U.S. PATENT DOCUMENTS

| | | | |
|---|---|---|---|
| 3,161,436 | A | 12/1964 | Hood |
| D284,151 | S | 6/1986 | Johnson |
| 4,679,262 | A | 7/1987 | Davis |
| 4,726,087 | A | 2/1988 | Schaefer |
| D317,236 | S | 6/1991 | Dixon |
| 5,154,649 | A | 10/1992 | Pender |
| 5,533,218 | A | 7/1996 | Fahy |
| 6,053,572 | A | 4/2000 | Doran |
| 6,154,905 | A | 12/2000 | Frydman |

(Continued)

OTHER PUBLICATIONS

International Search Report for PCT/US2015/60557 dated Mar. 11, 2016.

*Primary Examiner* — Loan H Thanh
*Assistant Examiner* — Megan Anderson
(74) *Attorney, Agent, or Firm* — Faegre Baker Daniels LLP

(57) ABSTRACT

A foam roller exercise device is provided for allowing a user to stretch anatomical muscles and performing traction along a vertebral spine of the user. The foam roller exercise device includes a first large elongated body portion taking a semi-cylindrical shape, forms into two second parallel small elongated semi-cylindrical body portions, both body portions meeting the elongated central inner groove. The user applies a downward pressure with the body onto the device, causing both parallel elongated body portions to open outwardly, thereby carrying the force to stretch onto the user's body.

24 Claims, 15 Drawing Sheets

(56) References Cited

U.S. PATENT DOCUMENTS

| | | | | |
|---|---|---|---|---|
| 7,288,077 | B2 * | 10/2007 | Notestine | A61F 5/01 128/845 |
| 8,252,024 | B2 * | 8/2012 | Bax | A61H 1/0292 5/630 |
| 8,434,492 | B2 * | 5/2013 | Jones | A47C 20/027 128/845 |
| 9,539,468 | B2 * | 1/2017 | Nagasaka | A63B 22/16 |
| 2006/0229538 | A1 | 10/2006 | Schmidt | |
| 2012/0122635 | A1 * | 5/2012 | Tsai | A61H 15/00 482/132 |
| 2016/0059063 | A1 * | 3/2016 | Breibart | A63B 23/185 482/123 |

* cited by examiner

FOAM ROLLER TRACT AND STRETCH DEVICE

CROSS-REFERENCE

This application claims priority of U.S. Provisional Application Ser. No. 62/079,898, filed Nov. 14, 2014 under 35 U.S.C. § 119(e), which is incorporated herein by reference.

BACKGROUND

The present device generally relates to exercise devices. More specifically, the present device relates to a foam roller exercise device for stretching and supporting a body.

Foam rollers are utilized in the performance of a number of physical exercises for enhancing core strength and stretching a user's posterior and abdominal muscle regions. In use, the user typically lies on his or her back with the foam roller between the user's back and a floor surface. The foam roller is positioned typically along the user's spine longitudinally or horizontally following the vertebral spines. Spine exercises promote balance, develop good posture, release muscle stiffness and emphasize balance awareness.

The foam rollers are typically made of semi-rigid polyethylene foam or other semi-rigid compressible plastic, and can vary in size. The foam rollers are shaped generally cylindrically or semi-cylindrically as a cylinder with a lumen tube. The foam rollers are used under the user's back on supine vertically and horizontally following vertebral spines. In vertical use, the line of contact refers to the touching area between the user's back and the foam roller that is applied on the center of user's back, which means above the spinous process of vertebral spines, the most prominent part of a vertebra bone, having no muscles, creating discomfort and pain on the contacted area when the user's body pressure is applied. In horizontal use, the line of contact refers to the touching area between user's back and the foam roller that is established on paraspinal and/or paravertebral muscles when the user is muscled or on the one of the spinous process of vertebral spines or between two spinous process on vertebral spines that promotes a lot of discomfort pressure on a sudden spinous process of vertebra spine in occasion. Especially, when the user is skinny, tiny and lower muscled, it reveals discomfort and displeasure during exercise on the formal rollers.

Therefore, there is a need for developing an improved roller that is more comfortable, effective and less stressful on the vertebral spines for stretching and strengthening the user's body.

SUMMARY

The present disclosure is directed as an exercise device or therapeutic roller for stretching and strengthening a user's body. The present roller provides support on the lordotic curve of a lumbar spine, and/or a cervical spine in general, stretches back muscles, and establishes traction on the vertebral spines in different use.

In accordance with an embodiment of the present disclosure, the apparatus has the two different body portions, one large longitudinal semi-cylindrical body portion and the other two small longitudinal semi-cylindrical body portions connected by a central inner longitudinal groove, and constructs an embodiment that can be applied between user's body and the floor surface in various directions and parts of the user's body.

In one embodiment, the one large semi-cylindrical outer surface can contact with the user's back, or the two small semi-cylindrical body portions connected by a central inner longitudinal groove can contact with the back vertically or horizontally along the user's spines vertically oriented. Also, the present device can be used in the other parts of the body as similarly described below in greater detail.

In another embodiment, the force from outside presses onto the two small longitudinal semi-cylindrical body portions, which follows to spread away from each other from the central inner longitudinal groove in an opposite direction relative to each other. The mechanism of the present device is applied onto the user's body to increase a joint space, to stretch muscles, and to increase flexibilities of the body.

The appearance of the present device can be modified to perform different functions, such as subsequently different sized, rearranged of the small and large body portions, constructed and shaped.

In general, the cylindrical surfaces of embodiment is positioned between the user's back and the floor surface, wherein the one large semi-cylindrical surface contacts with the user's back or the two small semi-cylindrical surfaces contacts with the user's back, for creating linear pressures longitudinally onto the user's back.

The one large semi-cylindrical creates a linear pressure area on the user's body and the two small semi-cylindrical portions create two linear pressure areas on the user's body. During use of the one large semi-cylindrical surface to contact on the user's body, the user's body is curved and stretched outwardly from a longitudinal central line, which refers to the line of conjoining convex areas of outer curved surface, the first contacted linear parts of the embodiment and user's body, the highest density portions, and the contacted surface.

In another way, the other two small semi-cylindrical outer surfaces connected by the groove is contacted to the user's spine, wherein originates two linear pressure portions, establishes the force of separation each linear pressure portions oppositely when the user's body weight is applied wherein stretches the muscle around the vertebral spines and supplies traction onto each spinal vertebrae. Further, the present device can be applied to the user's spines horizontally as well as vertically following vertebral spines arranged vertically.

The two small parallel semi-cylindrical outer surfaces can be textured or dispose of numerous protrusions, acupressure elements, to give enough acupressure for releasing muscle stiffness and spasm when the user is onto it. The one large semi-cylindrical outer surface can be established more than one central outer longitudinal groove wherein gives useful balance to the embodiment on the floor when the two small semi-cylindrical outer surfaces contacted onto user's body. The two semi-cylinder's outer surfaces can establish numerous amounts of horizontal grooves which create the protrusion elements to be adjusted and realigned into the different body curvature of the users.

In yet another embodiment, the body portions has more than one lumen tubes and/or lumen tubes filled in with other suitable materials or other supporting structures of different density, which can arrange or control density, flexibility, resilience of the present device and/or maintain the original shape of the device against body weights or forces from outside.

Additionally, a support panel can be used for adjusting the height of the embodiment which can be located on two semi-cylindrical outer surfaces and/or one longitudinal cylindrical outer surface. The present device can be manufactured using the method to adherence directly the foam to vinyl or similar materials without adhesive materials to save expenses, wherein the pre-cut vinyl is located on the mold then pours and/or injects the polyurethanes and/or similar materials into the mold.

BRIEF DESCRIPTIONS OF THE DRAWINGS

Figure 2A:
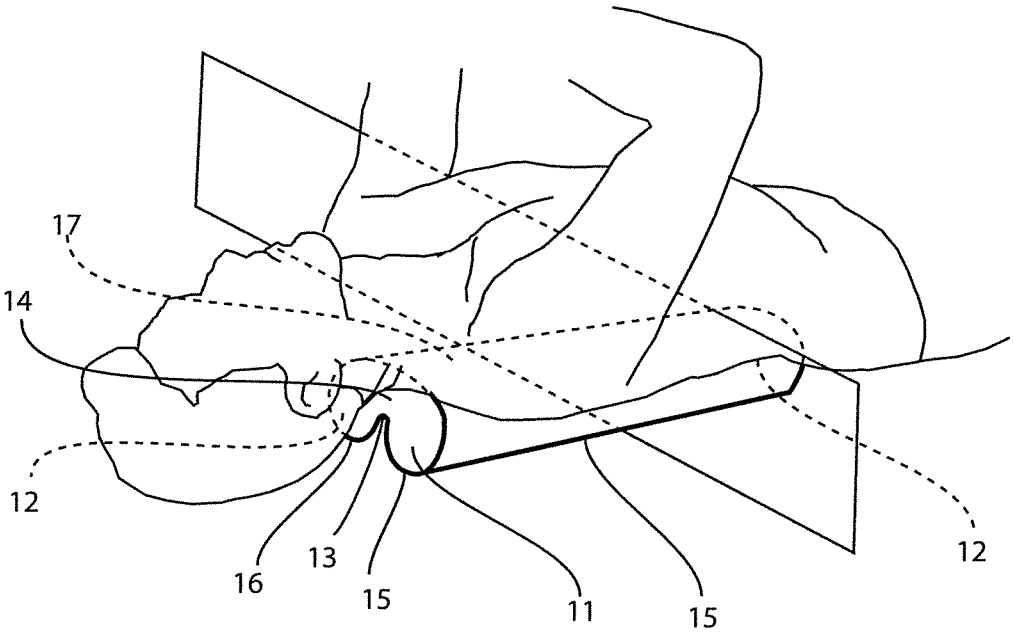
Figure 2B:
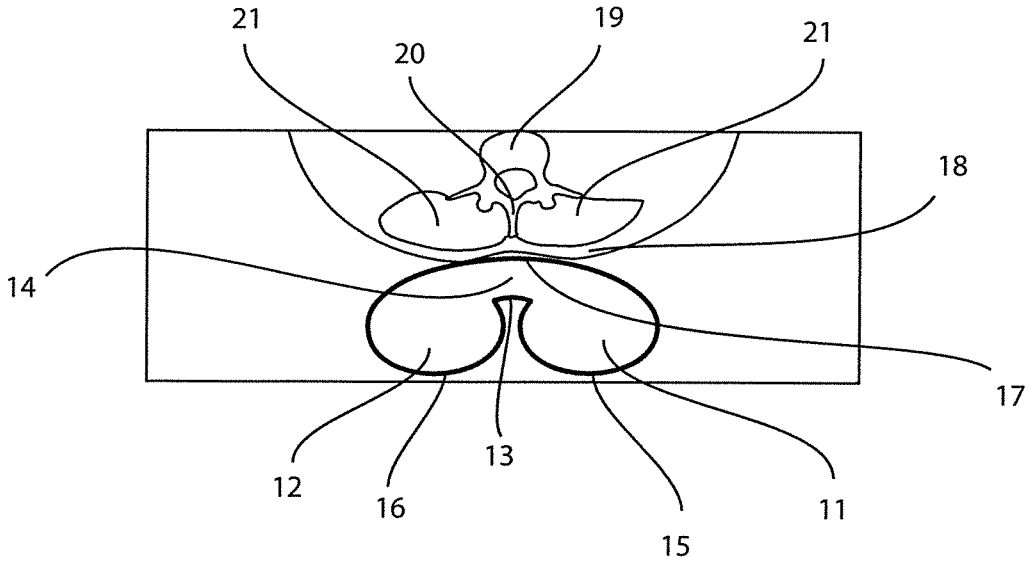
Figure 2C:
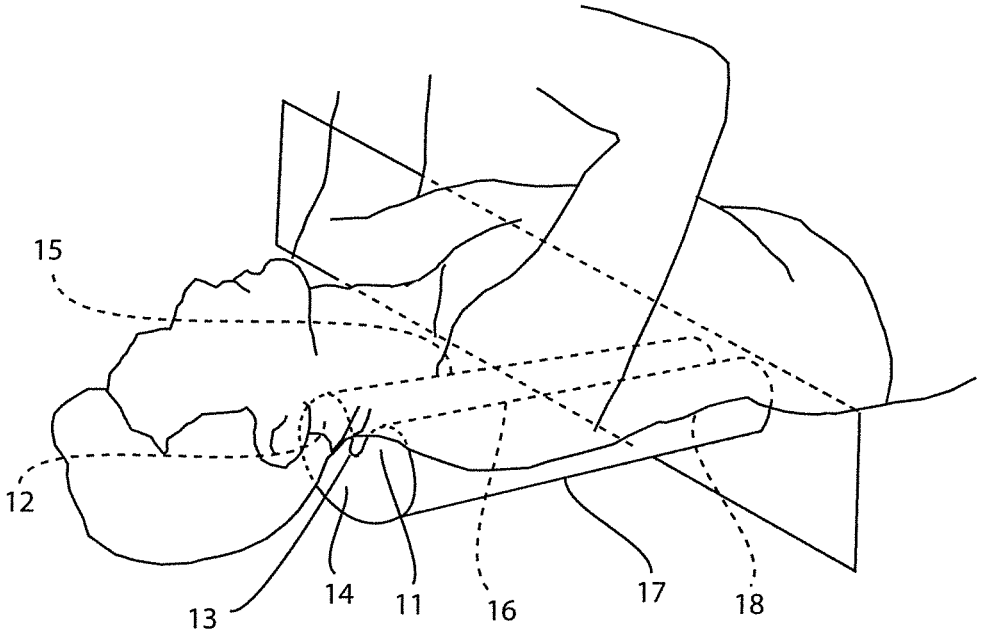
Figure 2D:
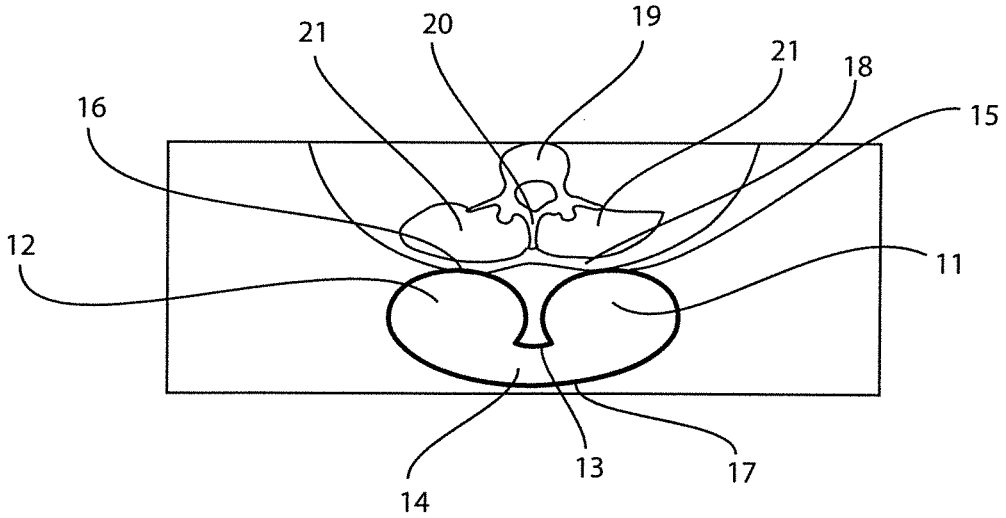
Figure 2E:
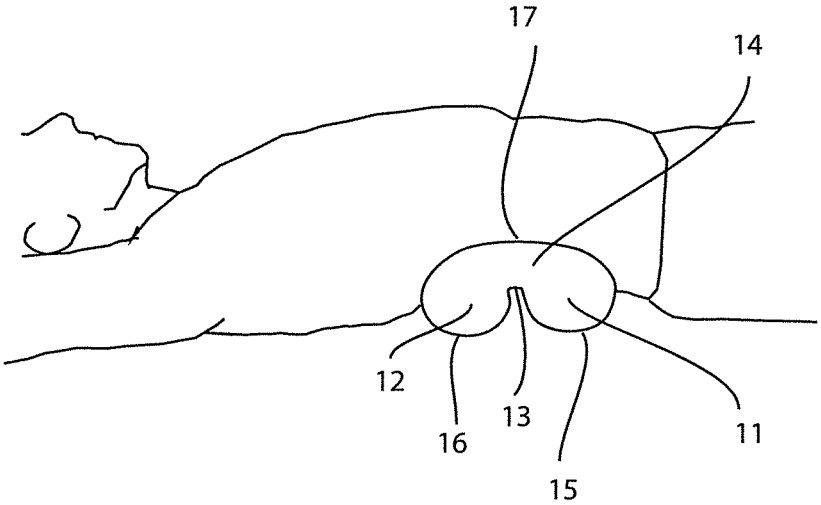
Figure 2F:
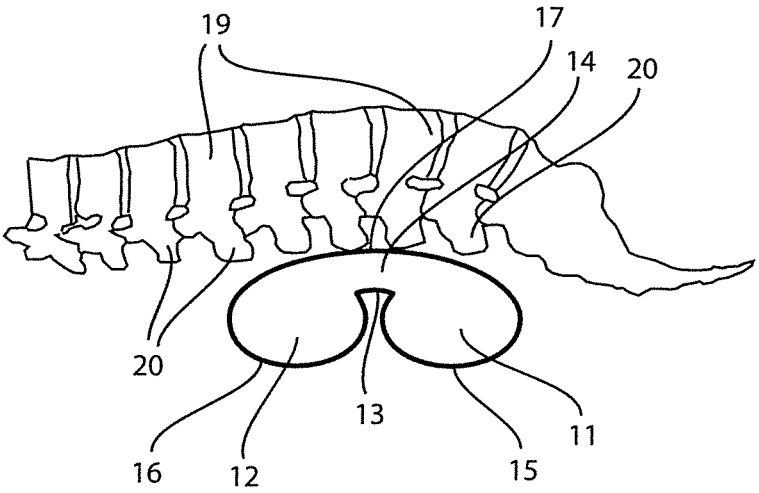
Figure 2G:
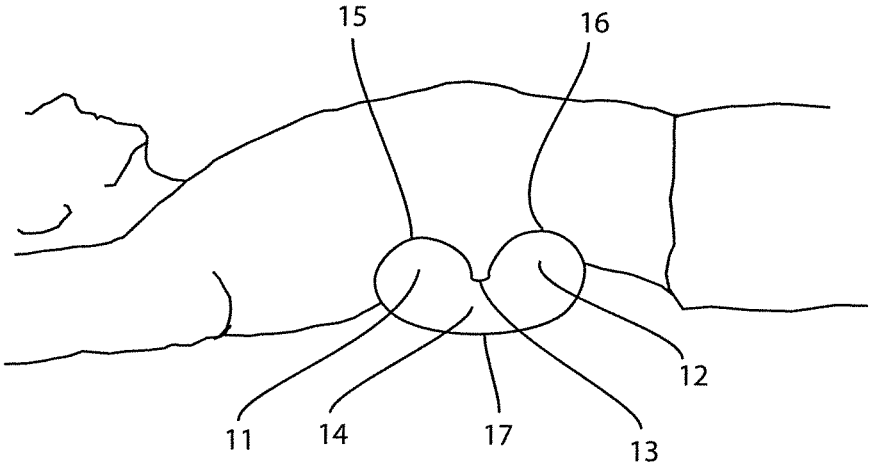
Figure 2H:
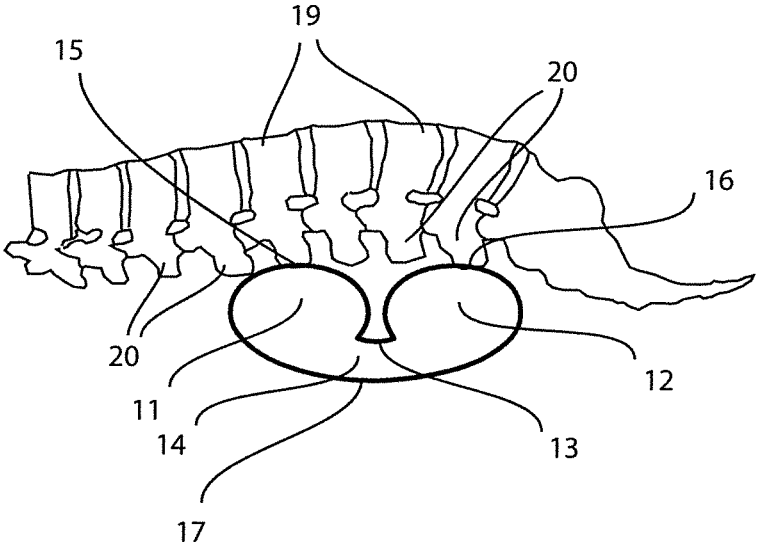
Figure 3:
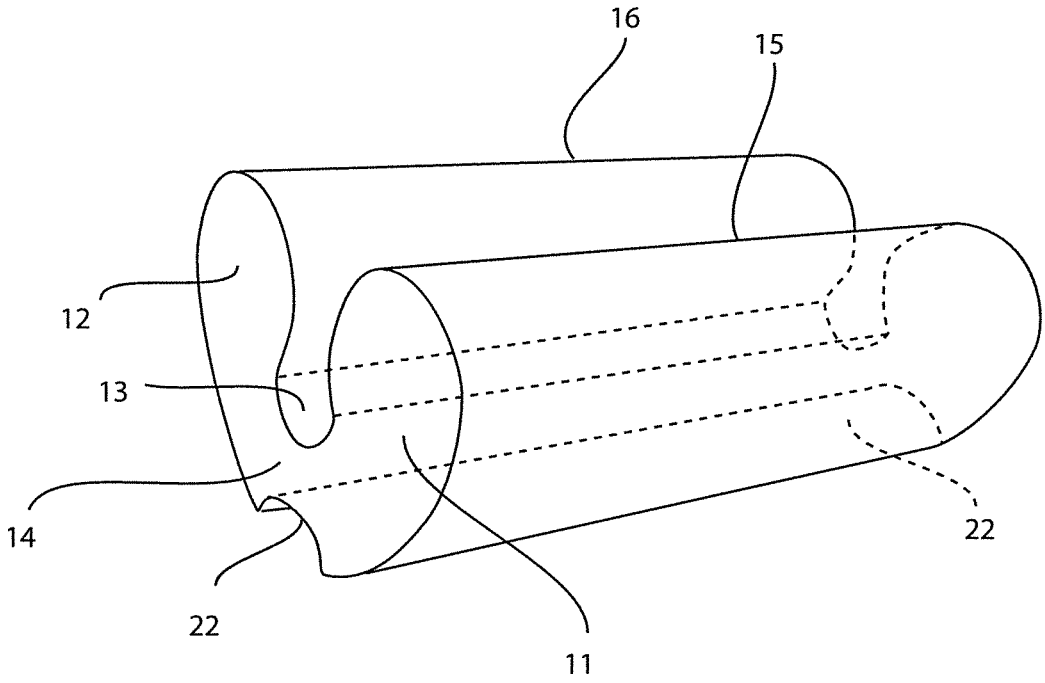
Figure 4:
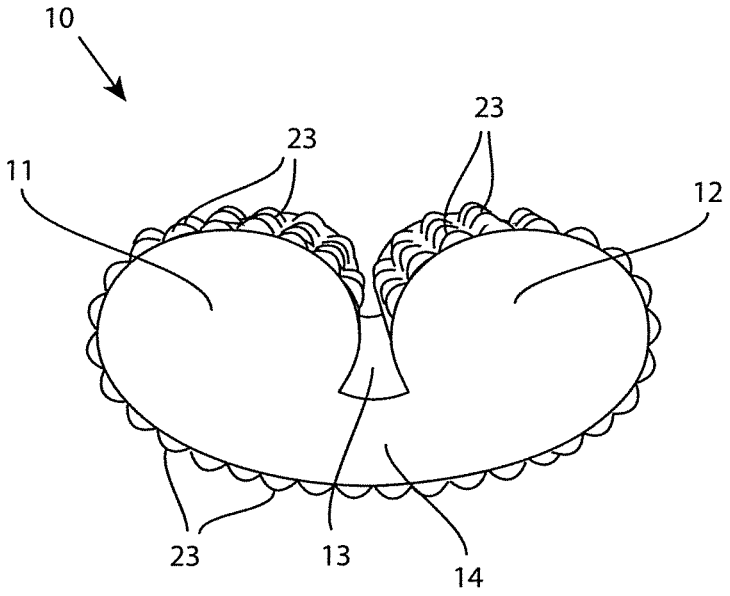
Figure 5A:
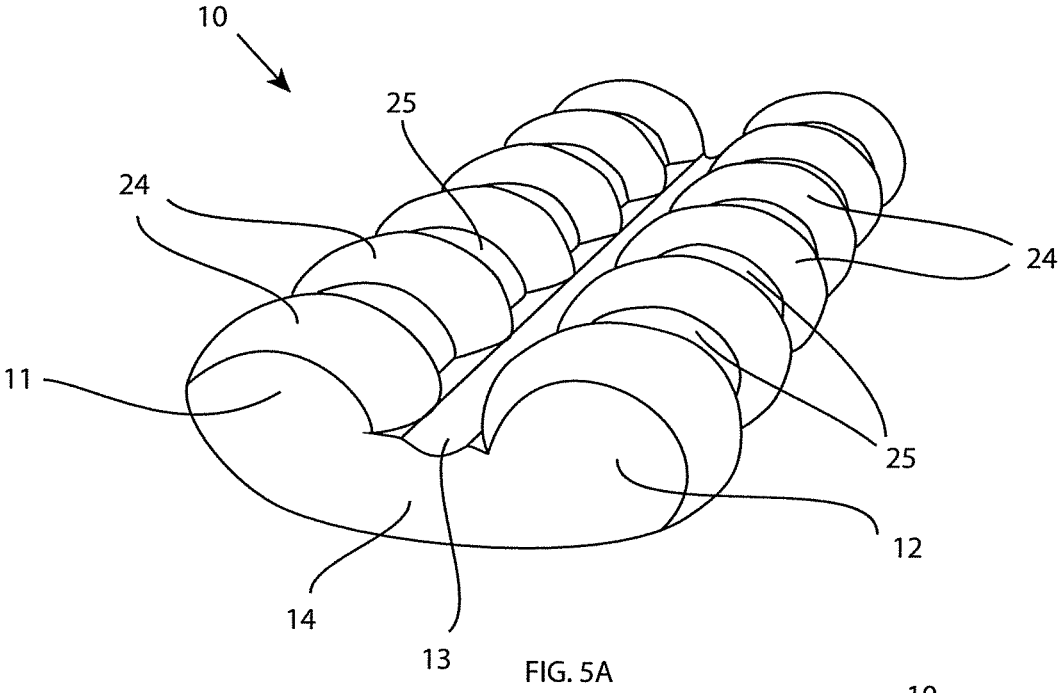
Figure 5B:
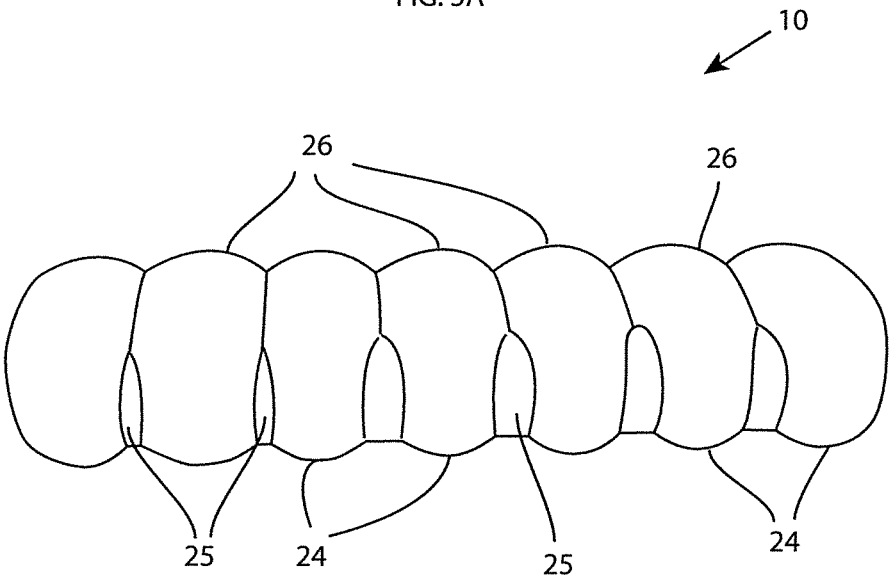
Figure 6:
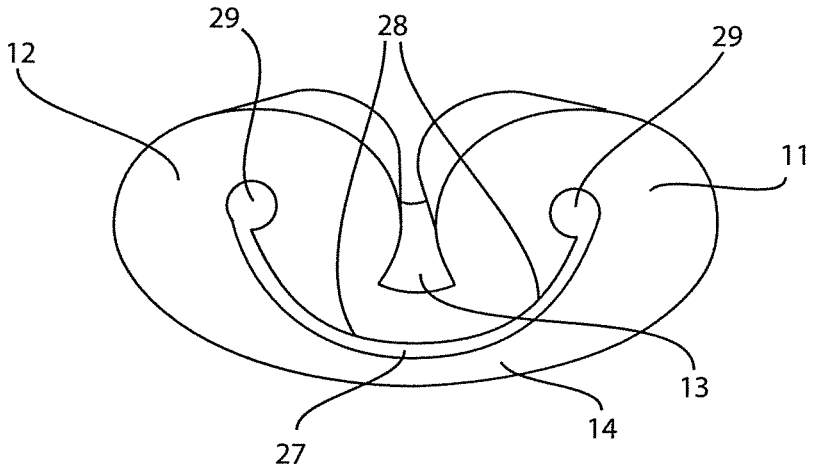
Figure 7A:
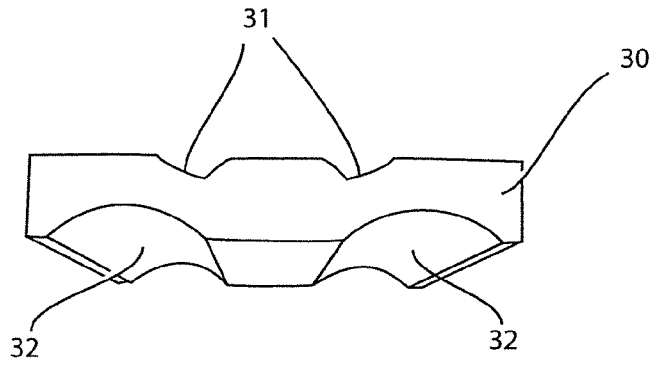
Figure 7B:
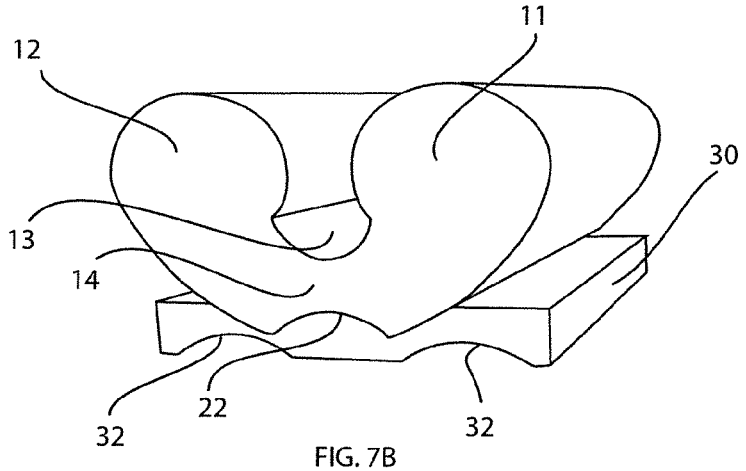
Figure 7C:
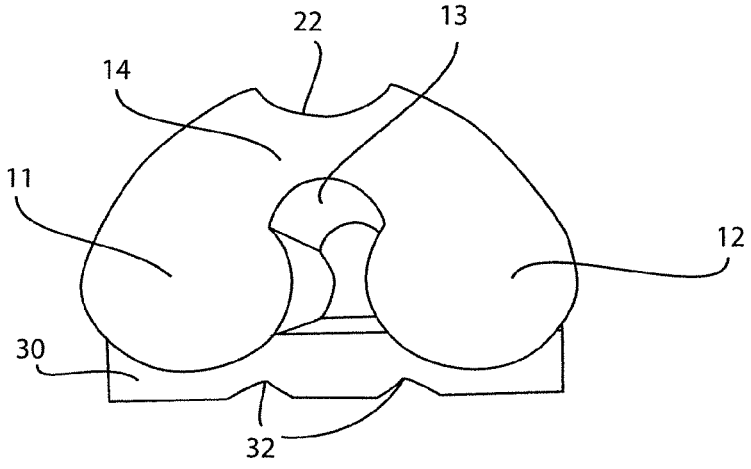
Figure 8:
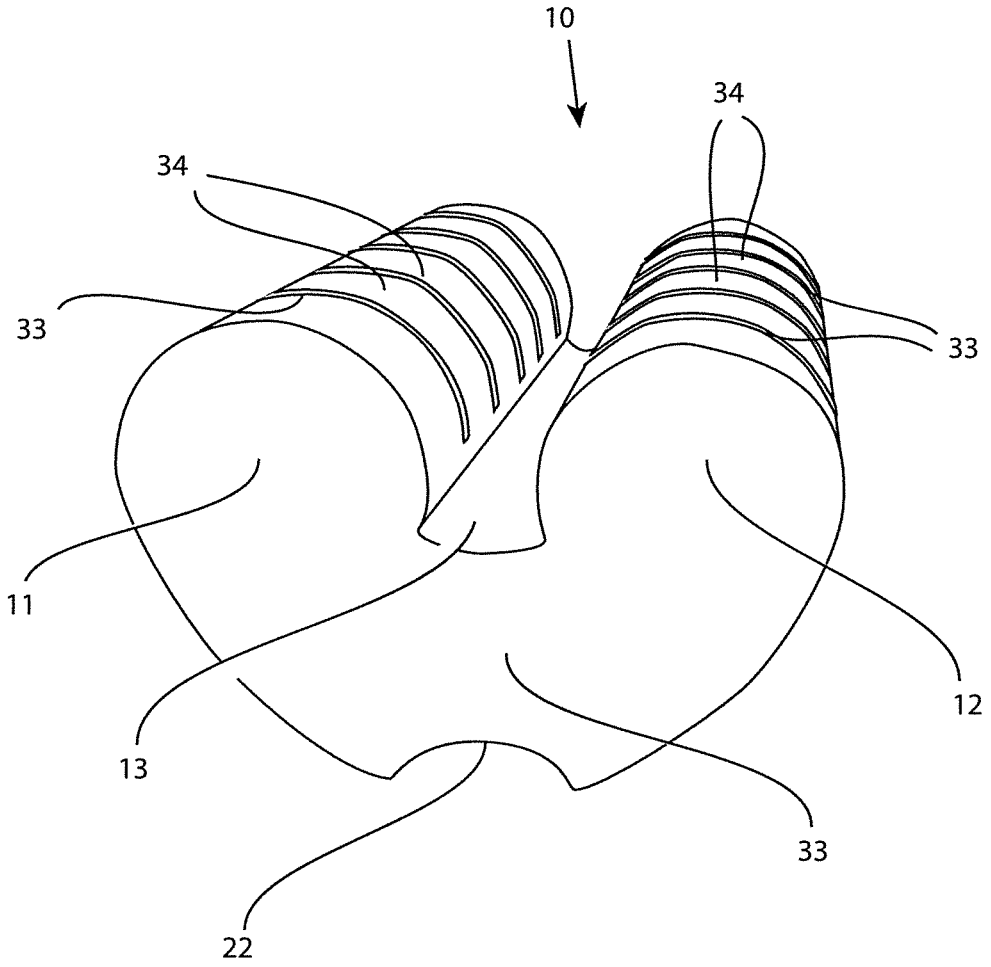
Figure 9A:
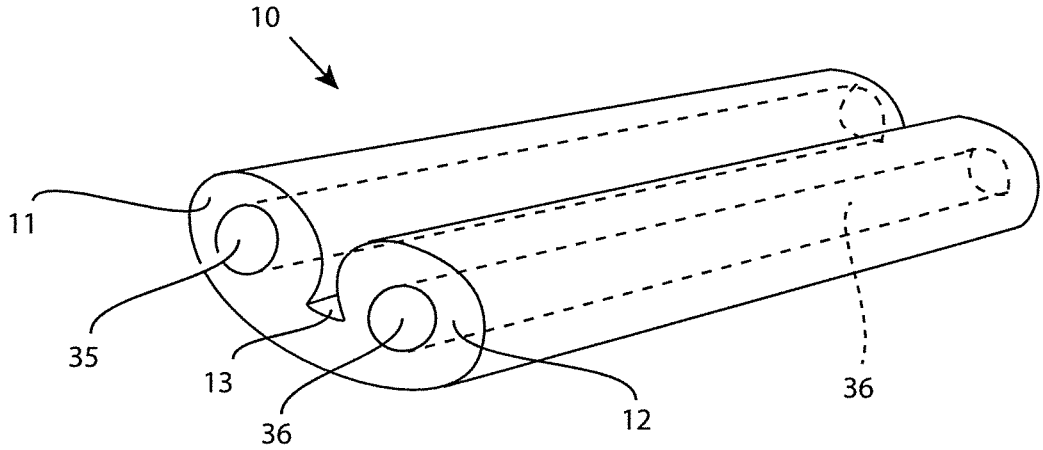
Figure 9B:
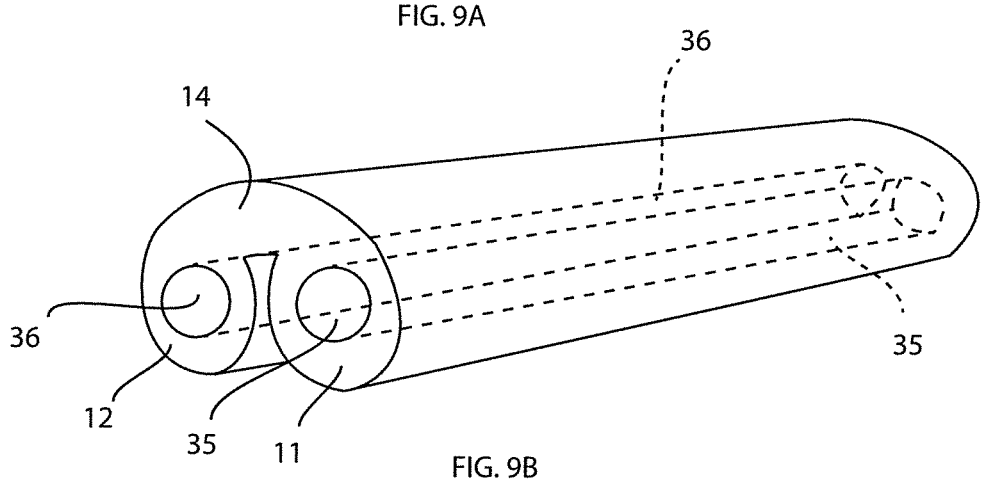
Figure 9C:
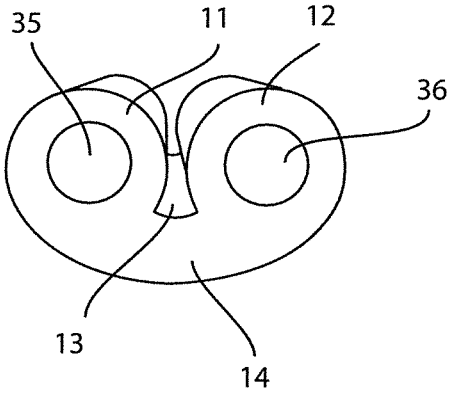
Figure 10:
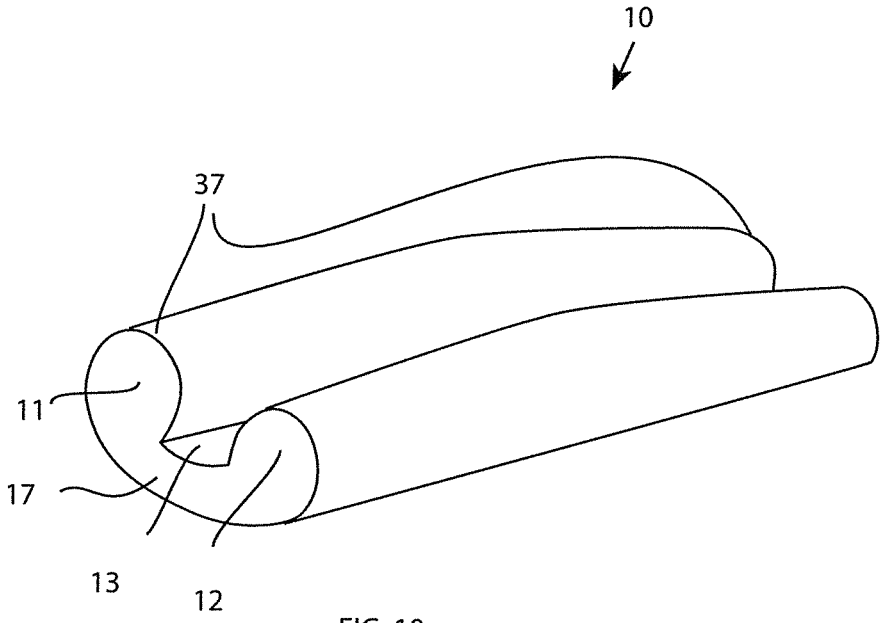
Figure 11:
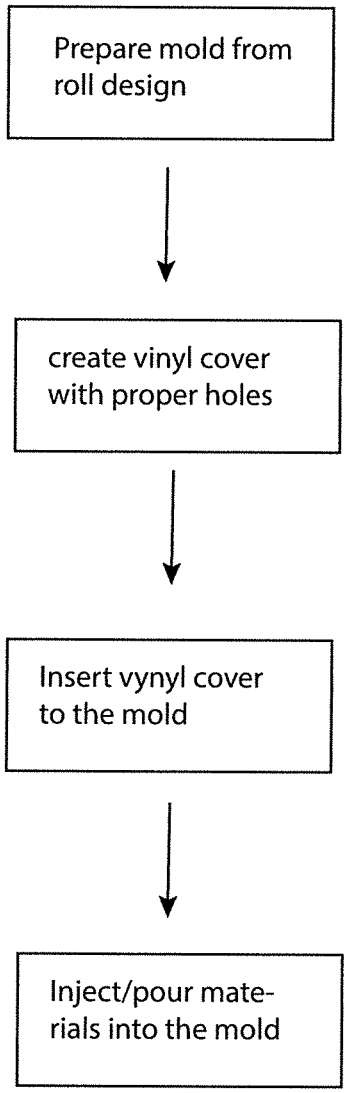
Figure 12A:
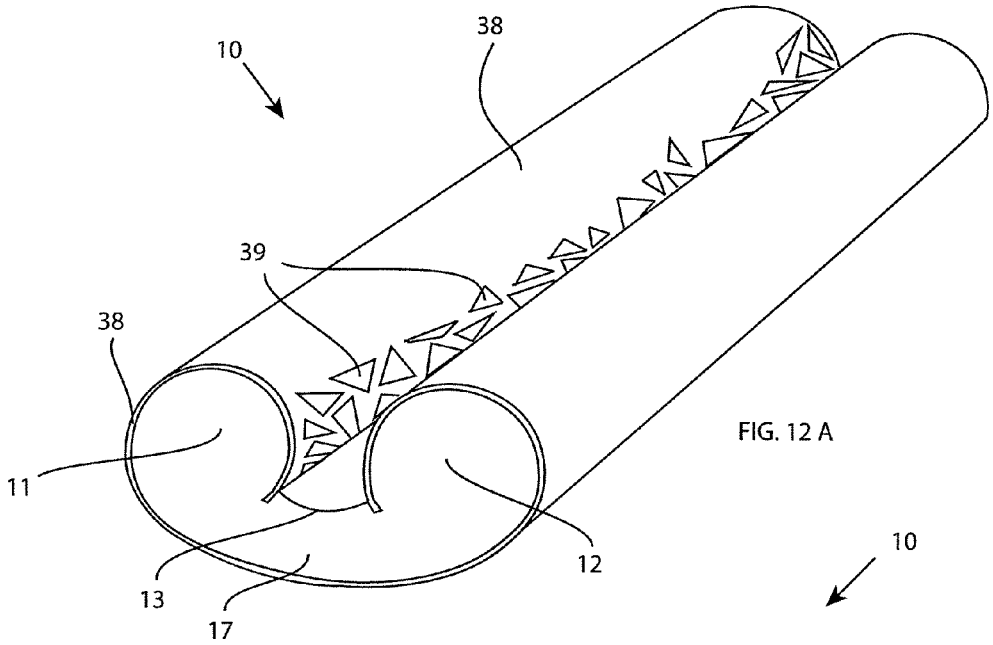
Figure 12B:
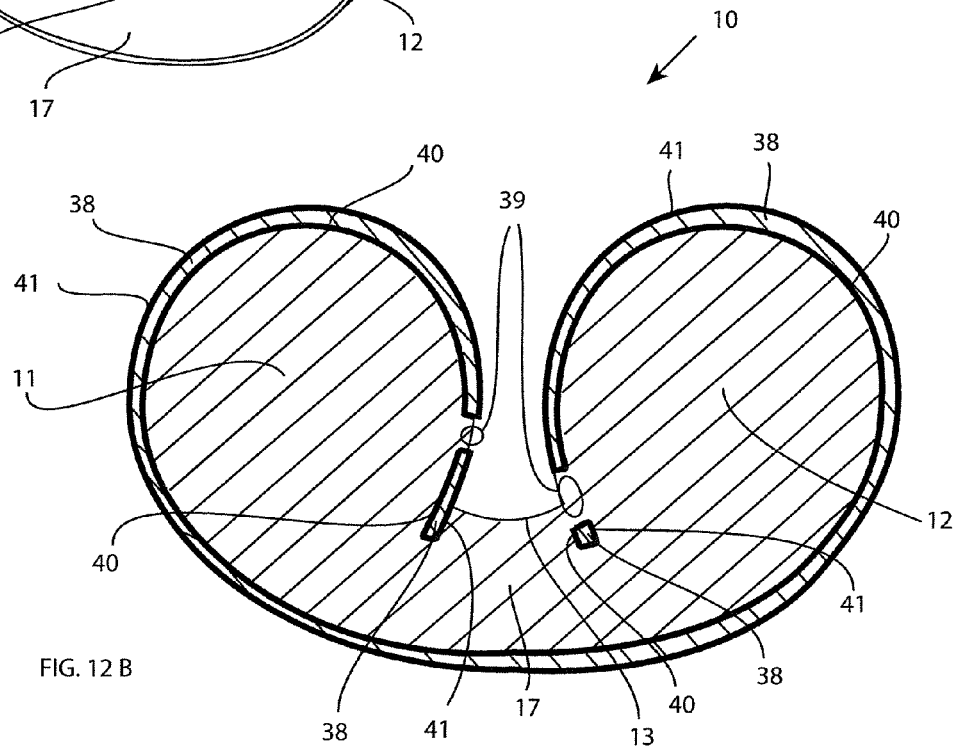

FIGS. 2A-H illustrate various views of an embodiment of the present device as being used and positioned by a user;

FIG. 2A illustrates the user applying a preferred embodiment of the present device that locates one large semi-cylindrical surface contacting the user's back vertically;

FIG. 2B illustrates a horizontal dimension cutting view of the present device shown in FIG. 2A;

FIG. 2C illustrates the user applying a preferred embodiment of the present device that locates two small semi-cylindrical surfaces contacting the user's back vertically;

FIG. 2D illustrates a horizontal dimension cutting view of the present device shown in FIG. 2C;

FIG. 2E illustrates the user applying a preferred embodiment of the present device that locates one large semi-cylindrical surface contacting the user's back horizontally;

FIG. 2F illustrates a vertical dimension cutting view of the present device shown in FIG. 2E;

FIG. 2G illustrates the user applying a preferred embodiment of the present device that locates two small semi-cylindrical surfaces contacting the user's back horizontally;

FIG. 2H illustrates a vertical dimension cutting view of the present device shown in FIG. 2G;

FIG. 3 is a perspective view of another embodiment of the present device which has a central outer longitudinal groove on the large semi-cylindrical outer surface;

FIG. 4 is a side view of another embodiment of the present device that has a plurality of protrusions on an embodiment's outer surfaces;

FIGS. 5A-B are perspective views of another embodiment of the present device which has a plurality of horizontal grooves and protrusions on semi-cylindrical surfaces;

FIG. 6 is a side perspective view of another embodiment of the present device which has an inside support element to maintain embodiments curved shape and resilience;

FIGS. 7A-C illustrate floor support panel views of an embodiment of the present device which has a central longitudinal element with side two grooves for one large semi-cylinder and two grooves for the two semi-cylinders;

FIG. 8 is a perspective view of another embodiment of the present device which has a plurality of horizontal grooves on the two small semi-cylindrical outer surface portions and a central outer longitudinal groove on one large semi-cylindrical outer surface;

FIGS. 9A-C are perspective views of another embodiment of the present device which has a lumen in the two semi-cylindrical portions;

FIG. 10 is a perspective view of another embodiment of the present device where the central portion diameter is larger than corners of the two semi-cylindrical portions; and FIG. 11 is an exemplary procedure of manufacturing of the present device; and FIGS. 12A-B illustrate an exemplary design of a vinyl cover used with the present device.

DETAILED DESCRIPTION

Figure 1A:
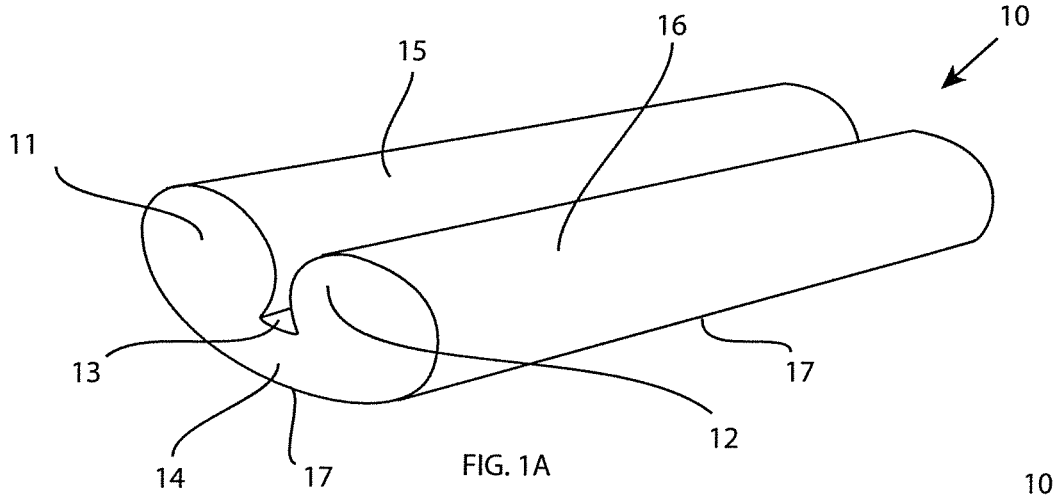
FIG. 1A is a perspective view of a preferred embodiment of the present device, illustrating two small semi-cylindrical outer surface portions on top.
Figure 1B:
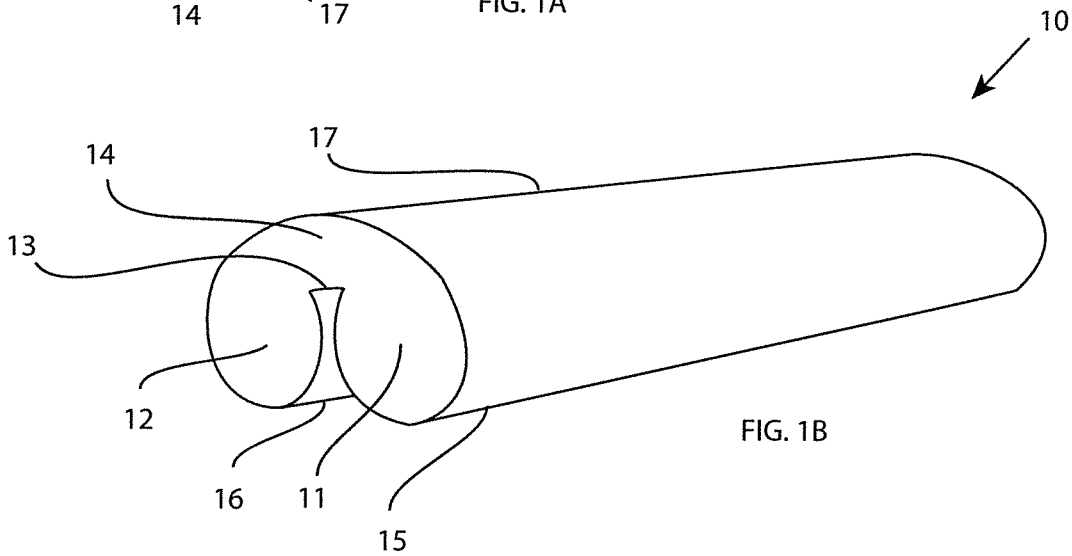
FIG. 1B is a perspective view of a preferred embodiment of the present device, illustrating one large semi-cylindrical outer surface portion on top.
Figure 1C:
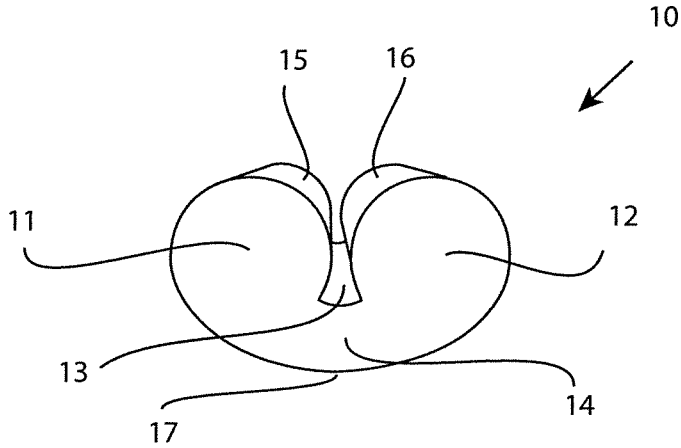
FIG. 1C is a side perspective view of a preferred embodiment of the present device.

As shown in the drawing for purpose of illustration, the present device is generally embodied in a foam roller 10, shown in FIGS. 1A-C, is the exercise device, preferred embodiment, has two small longitudinal body portions 11, 12 on one side, generally semi-cylindrical shaped outer surface 15, 16, and both longitudinal body portion 11, 12 connecting to the central inner groove 13 originating from the one large longitudinal body portion 14 on the other side. The two longitudinal body portions 11, 12 are substantially in parallel, equally sized and shaped each other.

The outer surface of large longitudinal body portion 17 is generally semi-cylindrical shape for conforming to a profile or contour of a cervical and lumbar lordosis of the user, or for stretching out the small longitudinal body portions oppositely each other by user's body weight, or for pleasuring the preferences or requiring of the user.

Although the outer surfaces of embodiment 15,16, and 17, the semi-cylindrical shapes, can be applied to unite other suitable geometric shapes, such as circular, triangular, rectangular, or hexagonal shapes.

It is contemplated that the present exercise device 10 is made of polyurethane foam, or other similar materials that can be suitable and comfortable for the user. The embodiment can be constructed by using vinyl or other fabrics that is filled with buckwheat or other similar materials.

FIG. 2A-H illustrates various views of the embodiment of the presents support device as being used and positioned by a user.

In the use of the embodiment, the embodiment can be positioned in two different surfaces wherein the one large semi-cylinder outer surface 17 contacts the user's body or the two small semi-cylinder outer surfaces 15, 16 connected by central inner groove 13 contacts the user's body. Also, the embodiment can be positioned in vertically or horizontally along user's spines vertically arranged.

The user apply the embodiment under user's body generates a linear pressure and/or linear pressures, wherein longitudinally contacted plane between the embodiment and the user's body, is created vertically along longitudinal dimension of the embodiment 10 and then extended horizontally.

FIG. 2A illustrates the one large semi-cylindrical outer surface 17 is placed under the user's body vertically, The user's body located on the embodiment creates a linear pressure, wherein a longitudinal contacted area between the embodiment and the user's body, to increased horizontally onto the user's body to be getting wider. In the procedure of further body weights apply on the embodiment, the user's body is curved and stretched out horizontally (FIG. 2B).

FIG. 2C-D illustrates the two small semi-cylindrical outer surface 15, 16 is placed under the user's back 18 vertically. The user's vertebral spines 19 is located on the above of central inner groove 13 of the embodiment 10, wherein applied no pressure on the spinous process of spinal vertebrae 20 which are most prominent bony parts of user's back 18, and one small semi-cylindrical outer surface 15 is positioned on the one side of paraspinal/paravertebral muscles 21 of the user's back 18, wherein most prominent and stiff muscles of the user's back 18, and the other semi-cylindrical outer surface 16 is positioned on the opposite side of same muscles 21 of the user's back 18.

The two semi-cylindrical outer surfaces 15,16 is pressed and utilize two liner pressures on the each side of paraspinal/paravertebral muscles 21 of the user's back 18 vertically, then the two small semi-cylindrical body portions 11, 12 are spread away each other from the central inner groove 13, wherein stretching out the user's body horizontally. The two small semi-cylindrical portions 11,12 of the embodiment 10 pressed by the user's back supply the acupressure on the paraspinal/paravertebral muscles 21 of the user back 18 wherein release muscle stiffness and tightness. The size and shape can be modified for the preference of the user.

FIG. 2E-F illustrates the one large semi-cylindrical outer surface 17 is contacted onto the user's back 18 horizontally, creates a horizontal linear pressure wherein a longitudinal contacted area between the embodiment 10 and the user's back 18. The horizontal linear pressure of the embodiment 10 can be located on the different segments of the vertebral spines 19 of the users back 18, which promotes the vertebral curvature to backward and/or supports the vertebral lordotic curvature depend on the locations of the embodiment on the user's spines.

On the FIG. 2E, the one large semi-cylindrical body portion 14 of the embodiment 10 is located on user's lumbar spine, that has the lordotic curvature, supports user's lumbar lordotic curvature.

On the FIG. 2F shows how the one large semi-cylindrical body portion 14 of embodiment 10 is positioned and supports the lordotic curve of the lumbar vertebral spine of the user.

FIG. 2G-H illustrates the two small semi-cylinder outer surface 15, 16 is placed under the user's back 18 horizontally. The two semi-cylindrical body portions 11, 12 are located on the different level of a vertebra or vertebrae to spread out each vertebra and/or vertebrae vertically, wherein traction applied on the vertebral spines on the above the central inner groove 13 of the embodiment 10. The two semi-cylindrical outer surfaces 15, 16 utilize two liner pressures horizontally, which the whole linear line spreads out user's body oppositely from the body part of the above of central inner groove 13 of the embodiment 10. Therefore the use's spine will be supplied traction onto the vertebral spine wherein increases the vertebral disc space.

FIG. 2G shows the user performs the embodiment 10 touched the two semi-cylindrical outer surfaces 15, 16 onto the user's back 18. On the FIG. 2H the two semi-cylindrical body portions are located on the lumbar spines of the users that supplies stretching the user's body to vertically and traction on the vertebral spines.

FIG. 3 is an embodiment which has a longitudinal center outer groove 22 extending through the length of the large semi-cylindrical outer surface 14. In using of the embodiment, the large semi-cylindrical outer surfaces 14 are positioned on the floor that the longitudinal center outer groove 22 of the large semi-cylindrical outer surface 14 is easily balancing the embodiment 10 and the user's body horizontally and vertically. Additionally, when the longitudinal center outer groove 22 is touched on the vertebral spine 19, decreases the pressure on the spinous process of vertebral spines 20 in vertical orientation.

FIG. 4 illustrates another embodiment that has a plurality of protrusions 23 on the outer surfaces of an embodiment, wherein the two small and one large cylindrical outer surfaces. When the user's body is applied on the embodiment, the prominent elements 23 supply acupressure on the user's body wherein release muscle stiffness and/or soreness on the applying body parts.

FIG. 5A-B illustrates another embodiment that has a plurality of protrusions 24, 26 and grooves 25 on the outer surfaces of an embodiment's outer surfaces 11, 12, and 14. The protrusions of embodiment 24, 26 can be sized and shaped to supply adequate acupressure for releasing muscles stiffness and tightness on the user's body when the embodiment 10 is applied by the user, wherein both the two small semi-cylindrical surfaces 15, 16 and one large semi-cylindrical surface 17. The protrusions 24, 26 and grooves 25 can be sized and shaped for pleasuring the preferences or requiring of the user.

FIG. 6 is showing an embodiment which has a curved longitudinal element 27 extending through the length of the elongated embodiment wherein the inside of the embodiment 10 to assign and maintain the curved shape and/or resiliency of the embodiment 10. The curved longitudinal element 27 has the proper resilience force to maintain the embodiment shapes against user's body weight without user's discomfort.

The curved longitudinal element 27 has concaved longitudinal inner surface, which is located around the center of embodiment, wherein to maintain adequately the semi-cylindrical shapes on the large body portion of embodiment 14 and distance of the small cylindrical body portions 11, 12 each other, and might has the prominent structures 29 on the corner of the curved elements which is located longitudinally extending though the length of the elongated embodiment 10. The materials and the shapes can be changed and re-arranged for the pleasuring and/or desiring the preference of the user and better effective function of the embodiment.

FIG. 7A-C is perspective views of the floor panel 30 for the embodiment 10 wherein raise up the height of embodiment to add the floor panel in two different sides of the embodiments 10. The floor panel 30 has two small side grooves 31 oriented longitudinally on one side, which can be positioned the one large cylindrical outer surface 15, 16 with longitudinal central outer grooves 22 of the embodiment 10, and two large side grooves 32 on the other side is oriented longitudinally which in the two small cylindrical outer surfaces 15, 16 can be positioned.

FIG. 7A shows, in general, the floor panel 30 has a rectangular shape with grooves 31, 32 on the top and bottom portions, which is structured to do positioning the embodiment 10 accurately. Generally, the embodiment 10 can be placed on the floor panel 30 to elevate the heights of embodiment ether directions, the two small semi-cylindrical outer surfaces 15,16 and the one large semi-cylindrical outer surfaces 17 of the embodiment 10 contact to the floor panel 30, depend on user's preference.

In FIG. 7B shows the one large cylindrical outer surface 17 with a longitudinal outer groove 22 positioned the side groove 31 on the one side of floor panel 30, and in FIG. 7C shows the two small semi-cylindrical outer surfaces 15, 16 positioned the large grooves 32 on other side of floor panel 30. In other ways, the floor panel 10 can be modified and changed the position of grooves, number of grooves, size of grooves, location of grooves means one side of the floor panel can positions the both side of the embodiment or one side of the floor panel can positions one side of the embodiment, and thickness and size of panel for the pleasuring and/or desiring the preference of the user and better effective function of the embodiment. Although the embodiment 10 is shown as being laid on the floor surface or the floor panel 10, it is contemplated that the embodiment 10 can be used uprightly against a wall or a back support of a chair, as preferred by the user.

FIG. 8 is showing a plurality of horizontal grooves 33 and elements 34 on two small semi-cylinder outer surfaces 15, 16. When the two small semi-cylindrical outer surfaces 15, 16 of the embodiment 10 are contacted to the user's body, the elements 34 move slightly to be adjusted and rearranged following the contact surface of the body shape comfortably. The elements 34 are generally shaped as semi-cylindrical and grooves 33 is narrow however those can be modified and changed the shape, depth and size depend on the preferences of the user and the shape of the bodies.

FIG. 9A-C shows the lumen tubes 35, 36 wherein to control the density and flexibility of the embodiment 10. The lumen tubes 35, 36, generally longitudinal cylindrical shapes, can be subsequently equal sized and located into the embodiment 10, however it can be changed and modified the length, diameter and shape for the convenience of the user. Additionally, the lumen tubes can be filled in the materials such as buck wheat, and similar substances, and/or another density of the supporting structures.

FIG. 10 shows another embodiment has the different alignment and variation of the embodiment which has the smaller sized the corner 37 of the two small semi-cylindrical portions 11, 12 and the wider central inner grooves 13.

FIG. 11 is the procedure to make the embodiment wherein the vinyl to attach a polyurethane or similar materials directly without any adhesive elements. The vinyl is located inside of mold to get the proper position and the polyurethane and/or similar materials will be poured and/or injected into the mold. In the methods of production of the embodiment, the covering materials is to be properly sized to cover the embodiment and opening holes on the sudden parts of the covering materials. The covering materials has the one side smooth surface, means the pouring and injecting materials not adhere to this side, and the other side is rough and/or irregular surface, means the pouring and injecting materials are strongly stick on the covering materials, which in the embodiment can combined one side of covering materials only. On sudden part of the procedures of constructing the embodiment, the pouring and injecting material should embrace the both side of covering materials.

By the reason of embracing the both side covering materials, the covering materials has the a plurality of opening holes that follows the pouring and/or injecting materials passes through the holes of covering materials then formed, means the pouring and/or injecting material attached on the rough and irregular side of covering materials and pass though the holes formed on the other smooth side of covering materials and united wherein the form can grasp the covering materials on the both side of covering materials. For example, the vinyl has two different sides as one is smooth, means hard to attach polyurethane, and other side is rough and irregular, means attaching sturdily polyurethane, which can be used on the covering materials of the embodiment. But when the polyurethane needs to stick both side of the vinyl then is hard to do cause by the one side is smooth, so the vinyl cover has the more than two opening holes which the polyurethane is pass through the holes and united a structure.

FIG. 12A-B is showing the design of vinyl cover 38 that has the triangle holes 39 wherein holding the vinyl cover to the forming elements in the conjoined area between the two semi-cylinder outer surfaces 15, 16 and central inner groove 13. During the procedure of the forming of the pouring and/or injecting materials, the materials are expending and passing to the triangle holes of cover vinyl 39 and forming the shape of the embodiment 10. The one rough and irregular side 40 of the vinyl stick to the outer surfaces of the embodiment and the other side as smooth side of the vinyl 41 with the holes 39 are stick because the forming of the materials pass though the holes of vinyl 39 and constructed, The design of triangle holes 39 can be changed to have same function, gripping and sticking, to the other shapes as circular, round, rectangular, or hexagonal shapes. The FIG. 12A shows the embodiment sticks to the vinyl cover with triangle holes. The FIG. 12B shows cross-sectional views of the embodiment with the vinyl cover with holes.

The matter set forth in the foregoing description and accompanying drawings is offered by way of illustration only and not as a limitation. While a particular embodiment of the present device has been described herein, it will be appreciated by those skilled in the art that changes and modifications may be made thereto without departing from the present disclosure in its broader aspects and as set forth in the following claims.

What is claimed is:

1. A device for at least one of stretching or supporting a body of a user, the device comprising:

a mid-portion having a substantially convex outer region and an opposite concave inner region; and a first elongated body portion and a second elongated body portion being integrally connected to the mid-portion and separated by a central inner groove having a width shorter than a width of at least one of the first and second elongated body portions, the central inner groove disposed on the concave inner region along a longitudinal length of the mid-portion, the first and second elongated body portions being disposed in a substantially parallel relationship relative to each other along a longitudinal axis of the mid-portion, both body portions extending from the same central inner groove, wherein the device is made of resilient material and configured to at least one of stretch or support the user's body upon the device in a transverse direction to the longitudinal axis of the mid-portion.

2. The device of claim 1, wherein a curved longitudinal element is disposed in the device, internally extending along the longitudinal axis of the mid-portion for maintaining a shape and resiliency of the device.

3. The device of claim 2, wherein the curved longitudinal element has a concave inner surface near a center of the device for maintaining a semi-cylindrical shape of the device.

4. The device of claim 2, wherein the curved longitudinal element has a pair of cylindrical structures at opposite ends of the curved longitudinal element when viewed in cross-section taken transverse to the longitudinal axis of the mid-portion.

5. The device of claim 1, further comprising a panel having two opposite sides configured for supporting the device for selectively altering an overall height of the device, the panel having a first pair of grooves on one side along a longitudinal axis of the panel, and a second pair of grooves on an opposite side along the longitudinal axis of the panel.

6. The device of claim 5, wherein at least one of the first pair of grooves and the second pair of grooves abuts at least one of the mid-portion, the first elongated body portion, and the second elongated body portion of the device when assembled.

7. The device of claim 5, wherein at least one pair of the first and second pairs of grooves matingly receives, in a complementary fashion, at least one of the first and second elongated body portions.

8. The device of claim 1, further comprising a cover having a plurality of bores and being configured for substantially encasing the device, at least partially exposing, through the plurality of bores, an outer surface of at least one of the mid-portion, the first elongated body portion, and the second elongated body portion.

9. The device of claim 8, wherein the cover has a rough side and an opposite smooth side, the rough side configured for gripping and sticking to the outer surface of the at least one of the mid-portion, the first elongated body portion and the second elongated body portion.

10. The device of claim 8, wherein at least one of the bores has a geometric shape of at least one of circular, round, rectangular, triangular, and hexagonal shapes.

11. The device of claim 1, wherein at least one of the first elongated body portion and the second elongated body potion has a lumen tube inside the corresponding first or second elongated body portion, extending along a longitudinal axis of the corresponding first or second elongated body portion.

12. The device of claim 11, wherein the lumen tube is filled with a material suitable for varying a density of the corresponding body portion of the device.

13. The device of claim 1, wherein the first and second elongated body portions have a generally cylindrical shape along the longitudinal axis of the mid-portion.

14. The device of claim 13, wherein the generally cylindrical shape of the first and second elongated body portions has a substantially circular cross-section.

15. The device of claim 1, wherein a central outer groove is disposed on the substantially convex outer region along the longitudinal axis of the mid-portion for balancing the device and the user's body.

16. The device of claim 1, wherein a plurality of protrusions are selectively disposed on an outer surface of at least one of the mid-portion, the first elongated body portion, and the second enlongated body portion for supplying acupressure on the user's body.

17. The device of claim 1, wherein a plurality of outer grooves are disposed on an outer surface of at least one of the first elongated body portion and the second elongated body portion substantially transverse to the longitudinal axis of the mid-portion in a substantially parallel relationship relative to each other.

18. The device of claim 1, wherein a plurality of outer grooves and protrusions are alternately disposed on an outer surface of at least one of the first elongated body portion and the second elongated body portion.

19. The device of claim 1, wherein the mid-portion has a generally semi-cylindrical outer surface along the longitudinal axis of the mid-portion.

20. The device of claim 1, wherein a plurality of circular grooves and a plurality of circular protrusions are alternately disposed on an outer surface of the first and second elongated body portions, each of the plurality of circular grooves being sandwiched by adjacent circular protrusions of the plurality of circular protrusions.

21. The device of claim 1, wherein at least one of the mid-portion, the first elongated body portion, and the second elongated body portion has a central opening dimensioned for accommodating insertion of a secondary structural element.

22. The device of claim 1, wherein an outer surface of at least one of the mid-portion, the first elongated body portion, and the second elongated body portion conforms to a profile of the user's body.

23. The device of claim 1, wherein a diameter of a central portion of at least one of the first elongated body portion and the second elongated body portion is larger than an outermost diameter of a corresponding elongated body portion.

24. A device for at least one of stretching or supporting a body of a user, the device comprising:

a mid-portion having a substantially convex outer region and an opposite inner region; and a first elongated body portion and a second elongated body portion being integrally connected to the mid-portion and separated by a central inner groove having a width shorter than a width of at least one of the first and second elongated body portions, the central inner groove disposed on the inner region along a longitudinal length of the mid-portion, the first and second elongated body portions being disposed in a substantially parallel relationship relative to each other along a longitudinal axis of the mid-portion, both body portions extending from the same central inner groove, wherein the device is made of resilient material and configured to at least one of stretch or support the user's body upon the device in a transverse direction to the longitudinal axis of the mid-portion, and wherein the first and second elongated body portions have a generally cylindrical shape along the longitudinal axis of the mid-portion.

* * * * *